US006698465B2

(12) United States Patent
Tanaka et al.

(10) Patent No.: US 6,698,465 B2
(45) Date of Patent: Mar. 2, 2004

(54) PROCESS FOR FILLING POWDER, APPARATUS THEREFOR AND PROCESS FOR PRODUCING COMPOSITE MATERIAL

(75) Inventors: Katsufumi Tanaka, Kariya (JP); Kyoichi Kinoshita, Kariya (JP); Tomohei Sugiyama, Kariya (JP); Takashi Yoshida, Kariya (JP); Eiji Kono, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/233,974

(22) Filed: Sep. 3, 2002

(65) Prior Publication Data

US 2003/0041915 A1 Mar. 6, 2003

(30) Foreign Application Priority Data

Sep. 3, 2001 (JP) ..... 2001-266319

(51) Int. Cl.[7] ..... B65B 1/04

(52) U.S. Cl. ..... 141/12; 141/71; 141/9; 141/100

(58) Field of Search ..... 141/12, 71–81, 141/9, 100, 104

(56) References Cited

U.S. PATENT DOCUMENTS

| | | | | |
|---|---|---|---|---|
| 4,966,696 A | * | 10/1990 | Allington et al. | 210/198.2 |
| 5,453,163 A | * | 9/1995 | Yan | 204/451 |
| 6,395,183 B1 | * | 5/2002 | Valaskovic et al. | 210/656 |

FOREIGN PATENT DOCUMENTS

| | | |
|---|---|---|
| JP | 5-279702 | 10/1993 |
| JP | 7-207303 | 8/1995 |
| JP | 10-180492 | 7/1998 |
| JP | 10-296498 | 11/1998 |

* cited by examiner

*Primary Examiner*—Steven O. Douglas
(74) *Attorney, Agent, or Firm*—Morgan & Finnegan, LLP

(57) ABSTRACT

A process for filling a powder includes the steps of charging a powder into a cavity of a container and, after the charging step, vibrating a swinging body on the powder which is held in the cavity, thereby filling the powder with a high density. Since the swinging body swings in the cavity, it is possible to fill the powder in the container with a high apparent density being improved much more than conventional processes for filling powders. The process is applicable to an apparatus for filling a powder and a process for producing a composite material.

11 Claims, 3 Drawing Sheets

PROCESS FOR FILLING POWDER, APPARATUS THEREFOR AND PROCESS FOR PRODUCING COMPOSITE MATERIAL

BACKGROUND OF THE INVENTION

1. Field of the Invention

The present invention relates to a process for filling a powder, process which is effective in manufacturing sintered members, composite materials, green compacts, preliminarily sintered members (or preforms), and so forth, and an apparatus therefor. Moreover, it relates to a process for producing a composite material, process which uses the process or the apparatus.

2. Description of the Related Art

Regardless of the types of powdery material such as metallic powder, ceramic powder and the like, there are a variety of processes for producing green compacts, and so on. For instance, metallic sintered bodies are produced by way of a process comprising steps, such as filling a metallic powder into a mold, molding the metallic powder by pressurizing, sintering the metallic powder, etc. When compact magnetic cores, and so forth, are produced, sintering the metallic powder is not carried out, but filling a metallic powder as well as molding the metallic powder by pressurizing are carried out. In the case of molded bodies of ceramic, filling a ceramic powder, molding the ceramic powders together with a binder, and so forth, and further calcining the ceramic powder are carried out. Depending on the types of products, there are a great variety of processes for producing such green compacts, and so on. However, the step of filling a powder in a cavity is usually carried out in all of the cases.

In the meantime, depending on how the filling step is carried out, there is a fear of varying the dimensions, densities, and so forth, of molded bodies, sintered bodies, and the like. Hence, in order to attain the dimensional stability, high densification, and so on, a variety of measures have been developed so that the filling ability can be enhanced in the filling step.

For example, Japanese Unexamined Patent Publication (KOKAI) No. 7-207,303 and Japanese Unexamined Patent Publication (KOKAI) No. 10-180,492 disclose processes in which a vibration is applied to a powder which is put in a cavity. Moreover, Japanese Unexamined Patent Publication (KOKAI) No. 10-296,498 and Japanese Unexamined Patent Publication (KOKAI) No. 5-279,702 disclose processes in which a powder is divided into several portions and each portion is filled separately in a cavity.

However, even if it is possible to improve an apparent density of a powder by such processes, the resulting apparent density and uniformity have not necessarily arrived at sufficient levels. Hence, it has been desired to develop a filling process which makes it possible to furthermore improve the apparent density, and so forth.

SUMMARY OF THE INVENTION

The present invention has been developed in view of such circumstances. Namely, it is an object of the present invention to provide a process for filling a powder, process which can furthermore improve the filling ability of a powder, and an apparatus therefor.

Moreover, it is another object of the present invention to provide a process for producing a composite material, such as a process which uses the filling process or apparatus according to the present invention.

Note that, as illustrated in FIG. 4, Japanese Unexamined Patent Publication (KOKAI) No. 7-207,303, set forth above, discloses a process comprising the steps of filling a powder by putting a weight on a powder which is held in a container; and vibrating the container. However, the weight merely applies a load continuously to an upper layer portion of the powder which is held in the container. Specifically, the load which is applied to the powder is made uniform in the vertical direction so that it is simply intended to entirely improve the apparent density of the filled powder. Then, paragraphs [0008] and [0009] of the publication disclose that the filled volume of the powder is controlled by way of the weight by measuring the positions of the weight which sinks gradually in the container with a sensor. In view of the descriptions, it is not believed that the weight swings, for example, moves up and down in the vertical direction, and so forth, in the container. Therefore, it should be noted in advance that the process or apparatus which is disclosed in the publication differs completely from the present invention which will be described hereinafter with regard to the engineering concept and arrangement.

The inventors of the present invention have studied wholeheartedly in order to solve the aforementioned problems. As a result of trial and error over and over again, they thought of swinging a swinging body in a cavity in which a powder is held. Thus, they arrived at completing the present invention.

(Process for Filling Powder)

Namely, a process for filling a powder according to the present invention comprises the steps of: charging a powder into a cavity of a container; and, after the charging step, vibrating a swinging body on the powder which is held in the cavity, thereby filling the powder with a high density.

In accordance with the present powder filling process, in the vibrating step, the swinging body is swung actively in the cavity in which the powder is charged in the cavity. Here, the term, "swinging," implies that at least a part of the swinging body (e.g., usually, a lower portion thereof) moves in the vertical direction, and the like, so that it is repeatedly put in a state that it is brought into contact with or is kept on contacting with a top surface or an upper layer portion of the powder and conversely in a state that it is separated therefrom to float thereover. In this regard, the present powder filling process is distinguished from the conventional process in which the weight is placed on the top surface of the powder so that the weight pressurizes the powder continuously. Thus, by the vibrating step, the present invention can improve the filling ability of the powder more than the conventional process does. Although the mechanism has not necessarily been cleared yet, it is believed as follows at present.

When the swinging body swings in the cavity in which the powder is held, discontinuous contacts take place between the swinging body and the powder (e.g., especially, the upper layer portion). When the swinging body is brought into contact with the powder, the swinging body gives vibrations, loads, and so forth, to the powder. On the other hand, when the swinging body floats, it is possible for the powder to move freely. The repetition of these operations promotes the movement of the powder. Accordingly, the constituent particles, or the like, move so as to engage with each other, and thereby occupy the positions where they mutually bury the respective spaces between them. Thus, it is believed that the constituent particles, or the like, transfer to such a filling state that they are furthermore densified. Note that the swinging direction of the swinging body is not limited to the vertical direction and accordingly the swinging body can swing in the horizontal direction or in the diagonal directions.

(Apparatus for Filling Powder)

The present invention is not limited to a process for filling a powder. For instance, it is possible to grasp the present invention as an apparatus for filling a powder, apparatus which can realize the present powder filling process.

Namely, it is possible to use the present invention to constitute an apparatus for filling a powder, apparatus which comprises: a container having a cavity into which a powder is charged; a swinging body disposed swingably in the cavity; and a vibrator for swinging the swinging body on the powder which is charged into the cavity.

(Process for Producing Composite Material)

Moreover, it is possible to grasp the present invention as a process for producing a composite material, process which uses the present powder filling process or the present powder filling apparatus.

Namely, the present invention can be a process for producing a composite material, wherein a reinforcement member is dispersed in a matrix metal, process which comprises the steps of: charging a powder of the reinforcement member into a cavity of a mold for casting; after the charging step, vibrating a swinging body on the powder which is held in the cavity, thereby filling the powder with a high density; and impregnating a molten metal of the matrix metal into the reinforcement member by pouring with pressure after the vibrating step.

In accordance with the present invention, it is possible to fill a powder with a high apparent density. For example, it is possible to readily produce a composite material in which a reinforcement member is dispersed in a matrix metal with a large filling ratio.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
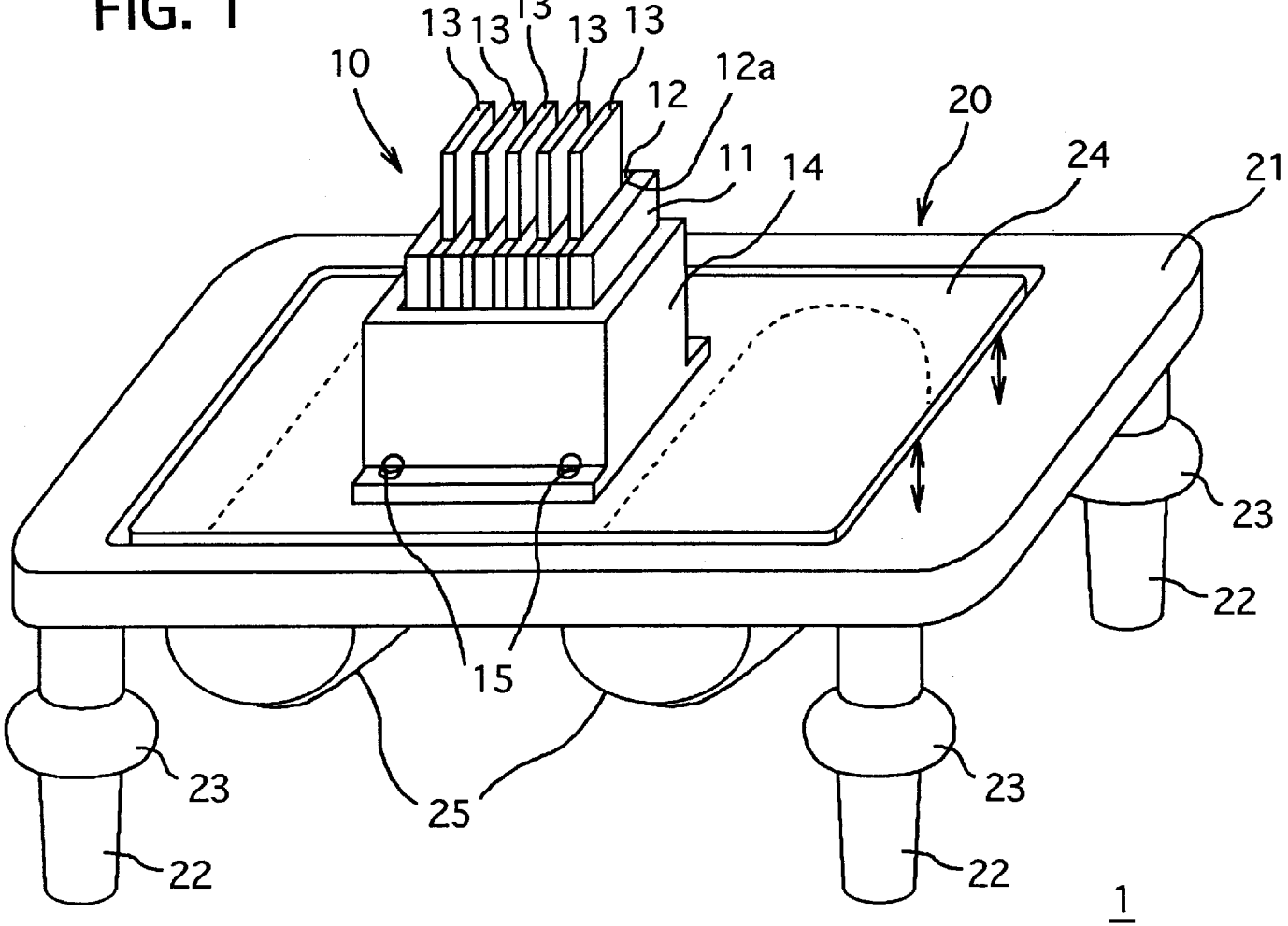
FIG. 1 is an overall schematic perspective view for illustrating a powder filling apparatus according to an example of the present invention.

Having generally described the present invention, a further understanding can be obtained by reference to the specific preferred embodiments which are provided herein for the purpose of illustration only and not intended to limit the scope of the appended claims.

Hereinafter, the present invention will be described more in detail with reference to specific embodiments. Note that the specific embodiments which will be described below are suitably applicable not only to the present powder filling process but also to the above-described present powder filling apparatus and composite powder producing process.

(Vibrating Step)

In the vibrating step, it is necessary to swing (e.g., jump, hop, or the like) the swinging body at least. For instance, it is possible to directly swing the swinging body by connecting the swinging body to a vibration source. However, in order to improve the apparent density, and so on, of the filled powder, it is furthermore effective to simultaneously vibrate the container in which the powder is charged. It is because the stirring of the powder is furthermore promoted by vibrating the container along with the swinging body. Then, when the swing body is swung by way of the vibrating container, it is possible to simplify a powder filling apparatus as well.

It is preferable to resonate the container in order to furthermore effectively carry out stirring the powder and in order to appropriately swing the swing body. The resonance occurs when the frequency of a vibration source (i.e., a vibrator) coincides with or approaches the eigenfrequency of a powder filling apparatus itself, apparatus which includes the container. When the eigenfrequency is that of a vibrating system from which the swinging body is excluded, the resonating state is likely to continue. However, in order to sustain the swinging of the swinging body as well as the resonance of the container, it is necessary to appropriately select and determine the mass, shape, and so forth, of the swinging body, the condition under which the swinging body contacts with the cavity, the force for vibrating the swinging body, and the like.

(Powder)

A usable powder is not limited to a particulate powder, but can be a fibrous powder. Moreover, it can be a metallic powder, a ceramic powder, or the other powders. However, in a case where ceramic powders are used, contrary to metallic powders, it is not easy to improve the apparent density of the filled ceramic powders by ordinarily pressurizing. Hence, the present powder filling process is effective to improve the apparent density especially when the powder is a particulate powder or a fibrous powder in which ceramic is a major component. Naturally, it is possible to further carry out the step of pressurizing the metallic or ceramic powder with a punch, and so forth, after the present powder filling process is carried out.

In order to furthermore improve the apparent density, it is furthermore preferred that the size of the constituent particles, or the like, of the powder is not one kind but two kinds or more. For example, it is appropriate that the particulate powder or the fibrous powder can be a composite powder which comprises particles or fibers having different sizes. This is because when particles or fibers having different sizes are combined, it is likely to mutually fill the spaces between the particles or fibers.

For instance, taking a particulate powder comprising SiC as an example, it is preferable to arrange the particulate powder so that it comprises coarse SiC particles having a major average particle diameter and fine SiC particles having a minor average particle diameter. The inventors of the present invention confirmed that it is possible to furthermore improve the apparent density, when the volumetric ratio of the coarse SiC particles with respect to the fine SiC particles is from 1.5 to 4.0 and the average particle diameter ratio of the coarse SiC particles with respect to the fine Sic particles is from 10 to 15. It is furthermore appropriate if the average particle diameter ratio is from 11 to 14, and if the volumetric ratio is from 2.0 to 3.0. Moreover, when the average particle diameters of the coarse SiC particles and the average particle diameter of the fine SiC particles are expressed specifically, it is appropriate if the average particle diameter of the coarse SiC particles is from 50 to 300 μm, and if the average particle diameter of the fine SiC particles is from 5 to 30 μm. It is much more preferred if the average particle diameter of the coarse SiC particles is from 50 to 200 μm, furthermore preferably from 75 to 150 μm, moreover preferably from 75 to 125 μm. It is much more preferred if the average particle diameter of the fine SiC particles is from 5 to 20 μm, furthermore preferably from 5 to 15 μm, moreover preferably from 7 to 10 μm. Here, the term, "average particle diameter," implies the average of particle diameters which are measured by a sieving testing method or an electric resistance method (as per Japanese Industrial Standard R6002).

Note that the composite powder can be produced by pulverizing raw materials mechanically or chemically. Alternatively, it is possible to mix commercially available powders whose average particles diameters, and the like, differ.

(Divided Filling)

In a case where the depth of the cavity is shallow, it is possible to carry out filling in which the powder is distributed substantially evenly with a high apparent density, even when the filling operation is carried out by charging a desired amount of the powder into the cavity at once. However, in a case where the depth of the cavity is deep, specifically, in a case where it is formed as a shape in which the ratio (H/S) of the height (H) with respect to the cross sectional area (S) is large, it is difficult to carry out filling in which the powder is distributed substantially evenly with a high apparent density, when a large amount of the powder is charged into the cavity at once. This is because the powder which is disposed at the lower portion of the cavity, and the powder which is disposed at the upper portion of the cavity are not stirred uniformly. Consequently, the deviation of the particle diameter in the vertical direction is likely to arise. Of course, it is possible to improve such a deviated distribution by carrying out the vibrating step for a long period of time. However, such a countermeasure is not practical at all.

Hence, the inventors of the present invention thought of properly dividing the powder and then filling the divided powder separately. Namely, it is a process in which the charging step and the vibrating step are carried out in this order a plurality of times repeatedly so that the powder is filled dividedly in the cavity. Specifically, the amount of the powder which is filled by carrying out the charging step one time and the vibrating step one time is controlled in a range where the uniform filling of the powder with a high apparent density can be attained. Then, by repeatedly carrying out the charging step and the vibrating step dividedly, it is possible to carry out filling in which the powder is distributed substantially evenly with a high apparent density as a whole, regardless of the cavity shapes. Note that the number of the divisions is suitably determined while taking the shape of the cavity, the productivity, and so forth, into consideration. Moreover, it is preferable to form a groove or the like in the boundary surfaces between the divided respective layers in order to improve the connecting ability between the layers.

(Radiator Component Member for Electronics Appliance)

It is appropriate to use the composite material for radiator component members for electronics appliances, composite material which is produced by the above-described production process according to the present invention. The radiator component members for electronics appliances transmit heat which is generated by the electronics appliances to the outside in order to radiate the heat from the electronics appliances. However, the application is not limited to the so-called heat sinks in particular. For example, it is possible to use the composite material for component members for adjusting thermal expansion, component members which intervene between heat sinks made from metals, such as aluminum alloys, etc., and ceramic substrates in order to carry out heat transmission. It is also possible to use the composite material for storage cases for electronics appliances, and so on.

In particular, when the composite material is used to form radiator component members, it is appropriate that the metal matrix comprises aluminum (Al) as a major component and the reinforcement member comprises silicon carbide (SiC) as major component.

Since SiC is has high conductivity and low expansibility, it is a preferable material for making radiator component members of semiconductor chips, and the like. However, when the radiator component members, and so forth, are made from SiC only, they do not have sufficient toughness, strength, and so on. Accordingly, by intervening Al of good thermal conductivity between particles, fibers and so on which are made from SiC, it is possible to produce radiator component members which are of good performance and handling ability. Moreover, when SiC particles, or the like, are directly filled into a cavity to produce a composite material, it is possible to obviate a binder, and the like, of low thermal conductivity and high expansibility. Consequently, it is possible to produce radiator component members of much higher performance.

Note that it is possible to carry out the impregnating step by using a molten metal of a metallic matrix which is pressurized to such an extent of from 50 to 150 MPa, for instance. It is needles to say that a cooling step, a solidifying step, a product removing step, a processing step, and so forth, can be carried out whenever they are necessary after the impregnating step.

(Others)

The powder filling process according to the present invention and the apparatus therefor are applicable to all of powdery green compacts, powdery sintered bodies, powdery calcined bodies, composite materials, and so on, and accordingly their applications are not limited in particular. Depending on the types of articles, it is possible to refer a molding mold, a casting mold, and the like, as the container provided with the cavity. Moreover, the container is not limited to those made from metals, for example, metallic molds, and can be those made from rubber as well, for instance, rubber molds.

EXAMPLE

Hereinafter, the present invention will be described more specifically with reference to a specific example.

(Powder Filling Process and Apparatus Therefor)

FIG. 1 illustrates an overall schematic diagram of a powder filling apparatus 1 according to an example of the present invention. In the present example, a plate-shaped composite material (e.g., Al—SiC) was produced by using the apparatus, and was used for making a radiator component member for an electronic appliance.

The powder filling apparatus 1 comprised a mold 10 (i.e., a container) for casting, and a vibrator 20.

The mold 10 comprised a plurality of first plate-shaped molding component members 11, and a plurality of second plate-shaped molding component members 12. The second plate-shaped molding component members 12 were disposed between the first plate-shaped molding component members 11, and were provided with a cut-off portion on the top side, respectively. The first and second plate-shaped molding members 11 and 12 were accommodated in a holder 14, and were laminated horizontally. Thus, a cavity 12*a* was formed in the respective second plate-shaped molding component members 12, and had a size of 4 mm in width, 140 mm in length and 90 mm in height. Into the upper opening of the respective cavities 12*a,* a plate-shaped swinging body 13 was fitted. The respective swinging bodies 13 could hop up and down in the vertical direction, had a size of 3.5 mm in width, 139 mm in length and 100 mm in height, and had a weight of 200 g.

Specifically, in the present example, five pieces of the second plate-shaped molding component members 12 and six pieces of the first plate-shaped molding component members 11 were disposed alternately to laminate, and thereby forming the mold 10 which was provided with five pieces of the cavities 12. Therefore, when the mold 10 was used, five pieces of composite materials were produced at the same time. However, in the present example, the mold 10 was a disposable mold, and accordingly a new mold was used for every casting operation. Note that the aforementioned five cavities 12*a* corresponded to filling positions 1 through 5 each of which is designated in FIG. 2 and FIG. 3 in the horizontal order. The filling positions 1 through 5 will be described later.

The vibrator 20 comprised a table 21, a vibrator bed 24 and vibrator motors 25. The table 21 was supported by four pieces of legs 22. The vibrator bed 24 was disposed on the table 21 so that it could vibrate up and down. The vibrator motors 25 made vibrator source for vibrating the vibrator bed 24. The above-described mold 10 was fastened onto the upper surface of the vibrator bed 24 with bolts 15 by way of a holder 14. In the present example, "KM25-2P" (trade name) motors which were made by Exene Co., Ltd. were used as the vibrator motors 25. Moreover, an air mount 23 was disposed in the middle of each leg 22, respectively. Note that, when the vibrator motors 25 were actuated, the air mounts 23 made it possible to inhibit the entire vibrator 20 from vibrating and to efficiently vibrate the vibrator bed 24 only.

The used powder was an SiC mixture powder (or a composite powder) in which two kinds of SiC powders having different average particle diameters are mixed with each. The SiC powders were produced by SHOWA DENKO Co., Ltd. Specifically, a first SiC powder and a second SiC powder were mixed in a proportion of 7:3 by volume to prepare the SiC mixture powder. The first SiC powder comprised coarse SiC particles having an average particle diameter of 100 $\mu$m. The second SiC powder comprised fine SiC particles having an average particle diameter of 8 $\mu$m. Note that, in the SiC mixture powder, the ratio of the average particle diameter of the first SiC powder with respect to that of the second SiC powder was 12.5 and the volumetric ratio of the first SiC powder with respect to the second SiC powder was about 2.3.

The SiC mixture powder was charged into each aforementioned cavity 12*a* (i.e., a charging step). The vibrator 20 was actuated to resonate the mold 10 (i.e., a vibrating step). Note that the times of separately charging the SiC mixture were tested in three patterns, once, three times and five times, in order to examine the differences between the apparent densities of the resulting green compacts. Moreover, the divided filling amount was made equal for every time the SiC mixture powder was filled into the cavities 12*a*.

Figure 2:
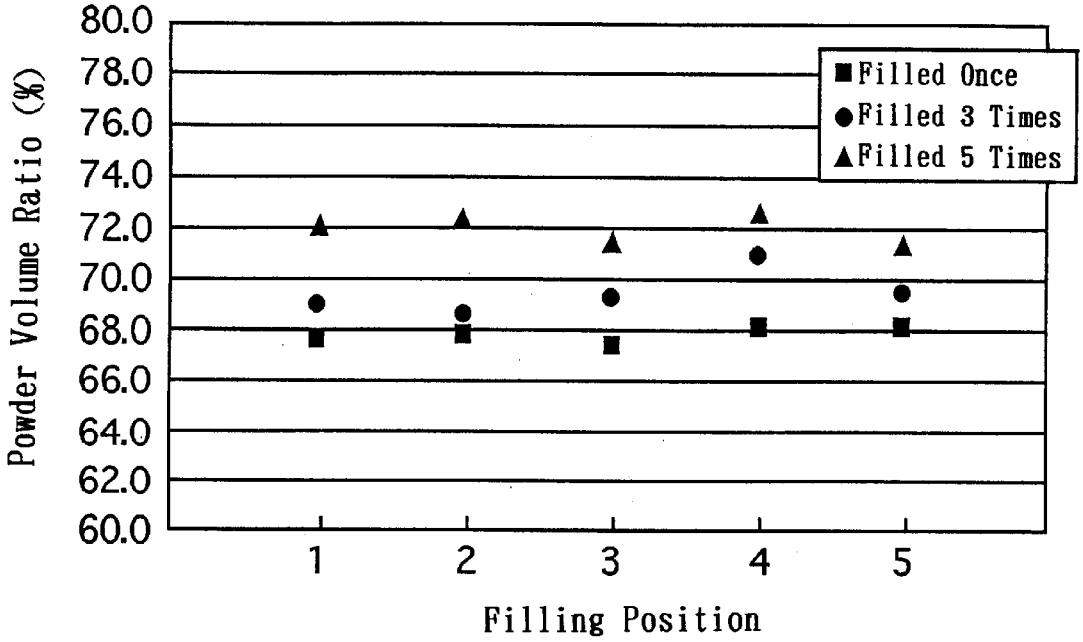
FIG. 2 is a graph for illustrating the relationships between the number of divided fillings and a powder volumetric ratio, relationships which were exhibited at respective filling positions.

Moreover, the vibrating step was carried out by resonating the mold 10 with the vibrating frequency at 60 Hz. Whether or not the mold 10 was resonated was judged by the variation amplitude while gradually rising the vibrating frequency. When the amplitude reached the maximum value substantially, it was considered that the mold 10 resonated. It is believed that the vibrating frequency in this instance substantially coincided with the eigenfrequency of the system from which the swinging bodies 13 were removed. In the present example, the vibrating step was carried out for from 30 to 60 seconds. Note that the time period required for the vibrating step depends on the number of the divided fillings of the SiC mixture powder. FIG. 2 illustrates the powder volume ratios (%) of the resultant green compacts after the vibrating step.

Note that the powder volume ratio is a ratio of a true volume of a powder which occupies in a predetermined volume. In other words, it is a value which is obtained by dividing an apparent density ($\rho$) by a true density ($\rho_0$) and by multiplying the resulting quotient value ($\rho/\rho_0$) by a factor of 100. From FIG. 2, it is understood that the more often the divided filling was carried out the higher the powder volume ratio rose, to put it differently, the higher the apparent density rose. Moreover, it is understood as well that, when the number of the divided fillings was proper, the apparent density was substantially constant, namely the apparent density was substantially uniform, regardless of the positions at which the SiC mixture powder was filled.

Figure 3:
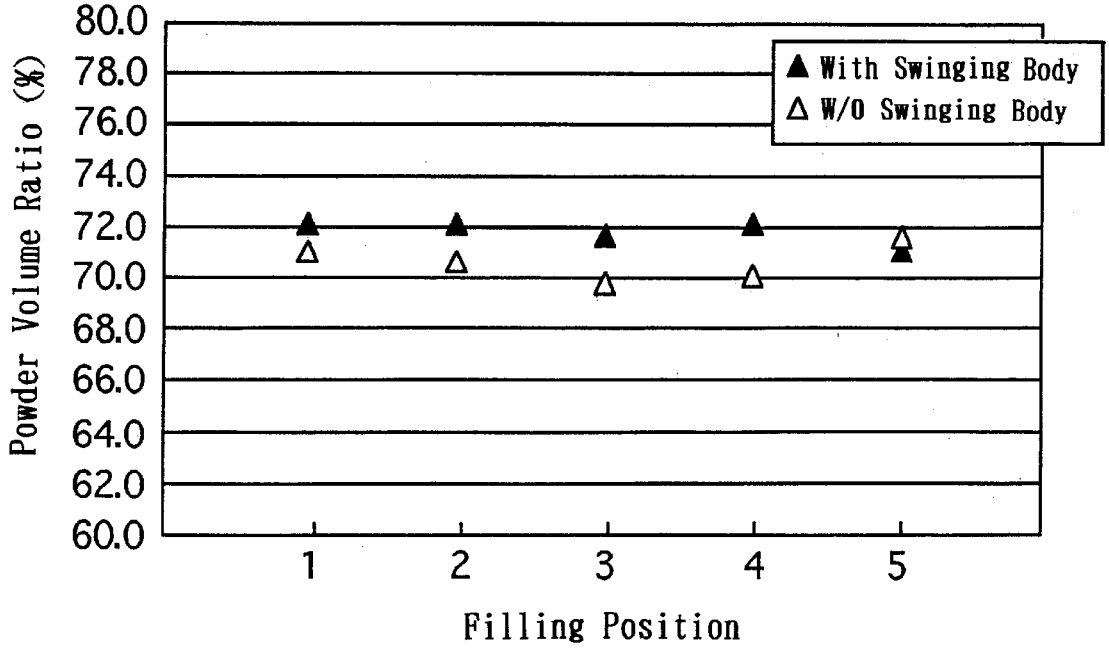
FIG. 3 is a graph for illustrating the difference between a case where a swinging body is present and another case where no swinging body is present when divided filling was carried out five times.
Figure 4:
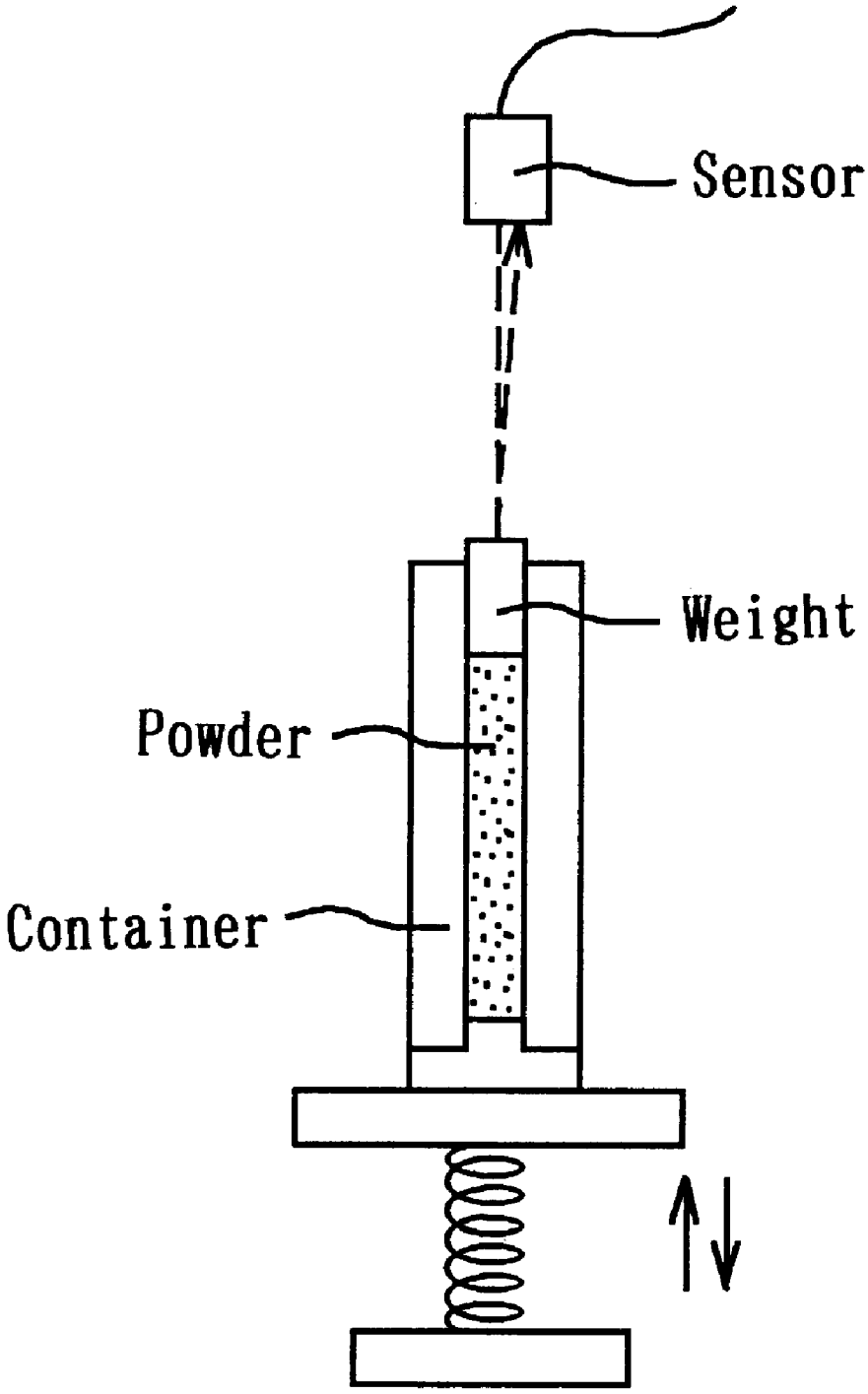
FIG. 4 is a drawing for illustrating the conventional powder filling apparatus.

Next, in the case where the divided filling was carried out five times, the variation of the powder volume ratios was examined when the swinging bodies 13 were disposed in the cavities 12*a* and when they were not disposed therein. FIG. 3 illustrates the results. From FIG. 3, it is understood that the powder volume ratio, namely the apparent density, was increased by disposing the swinging bodies 13 in the cavities 12*a*. Moreover, it is understood as well that the powder volume ratio was substantially constant regardless of the positions at which the SiC mixture powder was filled.

(Production Process of Composite Material)

As described above, the entire SiC mixture powder was divided into five parts and the filling step (i.e., a charging step and a vibrating step) was carried out five times without pressurizing the SiC mixture powder by means of a pusher, etc., and without mixing the SiC mixture powder with a binder, etc. Thereafter, into the cavities 12*a* in which the SiC mixture powder was filled, a molten metal of a metallic matrix was poured by pressurizing (i.e., an impregnating step). Specifically, a molten metal of pure aluminum (Al) was poured into the aforementioned cavities 12*a* by pressurizing to a pressure of from 100 to 140 MPa for from 3 to 10 minutes. Note that the pure aluminum was stipulated in Japanese Industrial Standard "A1050" and the molten metal was heated to 850° C. Moreover, prior to the impregnating step, the mold 10 had been heated to 800° C. in advance by an electric heater (i.e., a preheating step).

After the impregnating step, the mold 10 was air-cooled. After the molten metal was solidified (i.e., a solidifying step), the mold 10 was disassembled to take out cast articles (i.e., an article-removing step). Thus, five pieces of plate-shaped Al—Si composite materials were obtained which had a size of 4 mm in width, 140 mm in length and 80 mm in height.

Note that, depending on the requirements, the resultant composite materials can be machined to securely give the surface which contacts with electronic appliances the superficial roughness, the flatness, or the like, in order to form radiator component members for electronic appliances.

Having now fully described the present invention, it will be apparent to one of ordinary skill in the art that many changes and modifications can be made thereto without departing from the spirit or scope of the present invention as set forth herein including the appended claims.

What is claimed is:

1. A process for producing a composite material, wherein a reinforcement member is dispersed in a matrix metal, the process comprising the steps of:

charging a powder of said reinforcement member into a cavity of a mold for casting;

after the charging step, vibrating a swinging body on the power which is held in the cavity, thereby filling the powder with a high density; and impregnating a molten metal of said matrix metal into said reinforcement member by pouring with pressure after the vibrating step.

2. The process for producing a composite material according to claim 1, wherein said composite material is used for radiator component members for electronic appliances.

3. The process for producing a composite material according to claim 2, wherein:

said metal matrix comprises aluminum (Al) as a major component; and said reinforcement member comprises silicon carbide (SiC) as a major component.

4. The process for producing a composite material according to claim 1, wherein said vibrating step is such that said container is resonated.

5. The process for producing a composite material according to claim 1, wherein said powder is a particulate powder or a fibrous powder in which ceramic is a major component.

6. The process for producing a composite material according to claim 1, wherein said particulate powder or fibrous powder is a composite powder which comprises particles or fibers having different sizes.

7. The process for producing a composite material according to claim 1, wherein said charging step and said vibrating step are carried out in this order a plurality of times repeatedly, thereby dividedly filling said powder into said cavity.

8. The process for producing a composite material according to claim 1, wherein said powder comprises silicon carbide (SiC).

9. The process producing a composite material according to claim 1, wherein said powder comprises coarse SiC particles having a major average particle diameter and fine SiC particles having a minor average particle diameter smaller than the major average particle diameter.

10. The process for producing a composite material according to claim 9, wherein:

the volumetric ratio of said coarse SiC particles with respect to the fine SiC particles is from 1.5 to 4.0; and the average particle diameter ratio of said coarse SiC particles with respect to said fine SiC particles is from 10 to 15.

11. The process for producing a composite material according to claim 9, wherein:

said coarse SiC particles have an average particles diameter of from 50 to 300 $\mu$m; and said fine SiC particles have an average particle diameter of from 5 to 30 $\mu$m.

* * * * *